US007049733B2

(12) United States Patent
Lykowski et al.

(10) Patent No.: US 7,049,733 B2
(45) Date of Patent: May 23, 2006

(54) SPARK PLUG CENTER ELECTRODE ASSEMBLY

(75) Inventors: James D Lykowski, Temperance, MI (US); Darren C Downs, Northwood, OH (US)

(73) Assignee: Federal-Mogul Worldwide, Inc., Southfield, MI (US)

( * ) Notice: Subject to any disclaimer, the term of this patent is extended or adjusted under 35 U.S.C. 154(b) by 194 days.

(21) Appl. No.: 10/702,176

(22) Filed: Nov. 5, 2003

(65) Prior Publication Data

US 2005/0093412 A1 May 5, 2005

(51) Int. Cl.
*H01T 13/20* (2006.01)

(52) U.S. Cl. ..... 313/141; 313/118; 313/143

(58) Field of Classification Search ..... 313/141–143, 313/118, 132, 136; 123/143 R, 169 R
See application file for complete search history.

(56) References Cited

U.S. PATENT DOCUMENTS

| | | | | |
|---|---|---|---|---|
| 3,868,530 A | | 2/1975 | Eaton et al. | |
| 4,540,910 A | | 9/1985 | Kondo et al. | 313/11.5 |
| 4,684,352 A | | 8/1987 | Clark et al. | 445/7 |
| 4,771,210 A | | 9/1988 | Mohle et al. | |
| 5,273,474 A | * | 12/1993 | Oshima et al. | 445/7 |
| 5,347,193 A | * | 9/1994 | Oshima et al. | 313/141 |
| 5,395,273 A | | 3/1995 | Matsutani | 445/7 |
| 5,440,198 A | | 8/1995 | Oshima et al. | |
| 5,461,210 A | | 10/1995 | Matsutani et al. | 219/121.64 |
| 5,461,276 A | | 10/1995 | Matsutani et al. | 313/141 |
| 5,488,262 A | | 1/1996 | Takamura | 313/141 |
| 5,502,351 A | | 3/1996 | Katoh et al. | 313/141 |
| 5,510,667 A | | 4/1996 | Loffler et al. | |
| 5,557,158 A | | 9/1996 | Kanao et al. | 313/141 |
| 5,563,468 A | | 10/1996 | Abe et al. | 313/141 |
| 5,578,895 A | | 11/1996 | Oshima | 313/141 |
| 5,793,151 A | | 8/1998 | Kagawa et al. | 131/141 |
| 5,811,915 A | | 9/1998 | Abe et al. | |
| 5,877,584 A | | 3/1999 | Kato et al. | 313/143 |
| 5,982,080 A | | 11/1999 | Shibata et al. | |
| 5,998,913 A | | 12/1999 | Matsutani | |
| 6,095,124 A | | 8/2000 | Matsubara et al. | 123/594 |
| 6,166,479 A | | 12/2000 | Matsutani et al. | |
| 6,337,533 B1 | | 1/2002 | Hanashi et al. | 313/141 |
| 6,614,145 B1 | | 9/2003 | Fleetwood et al. | |

(Continued)

FOREIGN PATENT DOCUMENTS

DE 101 34 671 A1 6/2003

(Continued)

*Primary Examiner*—Joseph Williams
*Assistant Examiner*—Kevin Quarterman
(74) *Attorney, Agent, or Firm*—Dickinson Wright PLLC

(57) ABSTRACT

A spark plug having a center electrode assembly that includes a center electrode and precious metal insert that is both mechanically interlocked and welded to the center electrode in a manner that permits trapped gases to escape from between the two components. Also disclosed is a method for manufacturing the same. During assembly, the precious metal insert is placed into a blind hole that extends axially into a lower end of the center electrode. Once in place, the center electrode is deformed around an enlarged head section of the insert to mechanically interlock the two components together. To further strengthen this attachment, the two components are welded together about their circumference. In one embodiment, the weld includes several interruptions that function as vapor vents for any gases that may be trapped. In other embodiments, a radially or an axially-extending vent hole is used in lieu of the weld interruptions.

30 Claims, 2 Drawing Sheets

U.S. PATENT DOCUMENTS

| | | | | |
|---|---|---|---|---|
| 6,630,771 | B1 | 10/2003 | Ulm et al. | 313/144 |
| 2001/0030495 | A1 | 10/2001 | Kanao et al. | |
| 2002/0003389 | A1 | 1/2002 | Ishiguro | |
| 2002/0079800 | A1 | 6/2002 | Miyashita et al. | 313/143 |
| 2002/0105254 | A1 | 8/2002 | Hori et al. | 313/141 |
| 2002/0130602 | A1 | 9/2002 | Kanao et al. | 313/141 |
| 2002/0130603 | A1 | 9/2002 | Teramura et al. | 313/141 |

FOREIGN PATENT DOCUMENTS

| | | |
|---|---|---|
| EP | 0 834 973 A2 | 4/1988 |

* cited by examiner

SPARK PLUG CENTER ELECTRODE ASSEMBLY

FIELD OF THE INVENTION

The present invention relates generally to spark plugs, igniters, and other such ignition devices and, more particularly, to center electrode assemblies for such devices that utilize a precious metal insert at the firing tip.

BACKGROUND OF THE INVENTION

Spark plugs used in internal combustion engines are constantly subjected to environments having extreme temperatures and other potentially damaging elements. In order to combat such an aggressive environment and to protect the center electrode, certain precious metals are oftentimes employed at the firing end of the center electrode. These metals include platinum (Pt), iridium (Ir), and other noble metals exhibiting resistance to electrical erosion and chemical corrosion. It is known in the art to utilize these metals in the form of an insert; that is, a small, solid precious metal piece added to the lowermost tip of the center electrode. This provides a durable sparking surface without having to construct the entire electrode out of the precious metal, which could be economically impractical. Although the use of a precious metal insert may improve the consumption resistance (operational lifetime) and performance characteristics (ignitability) of the spark plug, its use may introduce new design and manufacturing difficulties. One of those difficulties involves the attachment of the insert to the firing tip in a manner capable of withstanding the extreme forces exerted upon it during use.

One method of attaching a precious metal insert to the firing tip of a center electrode is shown in U.S. Publication No. 2001/0030495 A1 issued Oct. 18, 2001 to Kanao et al. That publication discloses a spark plug center wire assembly with an iridium alloy insert having a stem portion and a head portion attached to a front end of a center electrode. As the head portion of the insert is pressed against the tip of the electrode, a resistance welding operation is applied causing the electrode tip to melt, thereby allowing the head portion of the insert, followed by the stem portion, to sink into the tip. As a result, the melted electrode tip surrounds the head portion of the insert, as well as a portion of the stem, thereby firmly attaching the two components together. The publication also discloses caulking of the electrode tip over the head portion of the insert to secure the insert in place.

Additional methods for attaching precious metal inserts to spark plug electrodes are taught in U.S. Pat. Nos. 3,868,530 and 4,771,210, each of which discloses the use of a mechanical interlock between the two components. In both the '530 and '210 patents, a cylindrical precious metal insert is inserted into the tip of a center electrode, after which an inwardly radial compression is exerted upon the center electrode. This causes deformation of both the center electrode and the precious metal insert such that a mechanical interlock between the two components is formed.

While these and other prior art utilize various methods and techniques for attaching precious metal inserts to center electrodes, including the use of mechanical interlocking features and various types of welds, there still exists room for improvement. For example, hermetically sealed welds between two dissimilar metals can experience stress in the form of expanding gasses trapped between the two materials. This stress can contribute to a failure of the weld such that the precious metal insert may separate from the center electrode.

It is therefore an object of the invention to provide a center electrode assembly which permits secure attachment of the precious metal insert to the center electrode in a manner that allows venting of the internal space between the two components.

SUMMARY OF THE INVENTION

The above-noted shortcomings of prior art electrode assemblies are overcome by the present invention which provides an electrode assembly for use in an ignition device such as a spark plug or igniter. According to one embodiment, the electrode assembly includes a center electrode and a precious metal insert. The center electrode and precious metal insert are secured to one another via a mechanical interlock and a vapor-vented weld. The vapor vented weld can take different forms, such as, for example, a peripheral weld which includes at least one interruption that permits trapped gases to escape from any space that exists between the center electrode and insert.

According to another aspect of the invention, the electrode assembly includes a center electrode, a precious metal insert, and a vent hole. Once assembled, the center electrode and precious metal insert are secured to one another via a mechanical interlock, and the vent hole provides venting between the two components.

The invention also includes an ignition device such as a spark plug or igniter utilizing the electrode assembly, as well as a method for manufacturing the electrode assembly and ignition device.

BRIEF DESCRIPTION OF THE DRAWINGS

Advantages and features of the present invention will be readily apparent with reference to the description, claims and drawings, wherein:

DETAILED DESCRIPTION OF THE PREFERRED EMBODIMENTS

Figure 1:
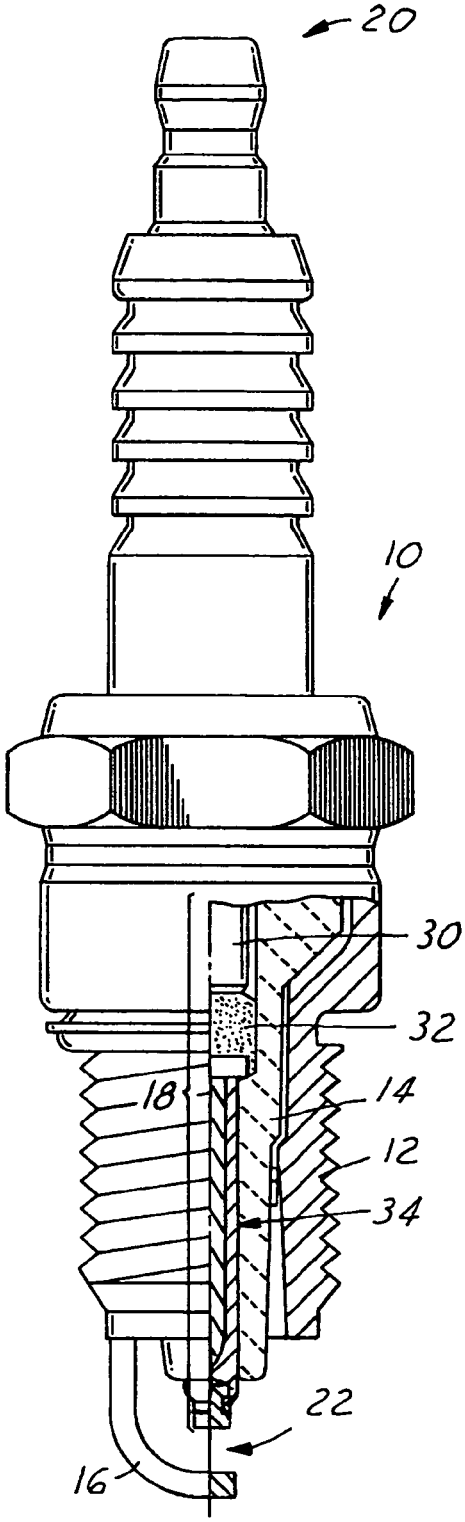
FIG. 1 is a partial cross-sectional view of a spark plug constructed in accordance with the present invention.

Referring to FIG. 1, there is seen a spark plug 10 generally including a metallic shell 12, an insulator 14, a ground electrode 16, and a center wire assembly 18. The metallic shell 12 includes a central bore in which the insulator 14 is fixed and the ground electrode 16 comprises a bent electrode that is welded or otherwise attached to a lower end of the shell 12. The metallic shell, insulator and ground electrode components are well known in the art, thus, a more detailed explanation of their structure and function is unnecessary. Center wire assembly 18 may comprise one of numerous combinations of components, and is used to deliver a high voltage ignition pulse from a terminal end 20, which is electrically coupled to a vehicle ignition system, to a spark gap 22, which is in communication with an ignition chamber. The particular combination of center wire assembly components seen here includes a terminal electrode 30, one or more conductive and/or resistive glass seals 32, and a center electrode assembly 34, although any of numerous other combinations of components could alternatively be employed. The center electrode assembly 34 refers to the lowermost electrode components of center wire assembly 18 which, in conjunction with ground electrode 16, forms spark gap 22. A high voltage ignition pulse travels from terminal end 20, through the center wire assembly, to center electrode assembly 34 where, from its lower tip, the ignition pulse arcs across spark gap 22, thereby initiating the combustion process. The structure and functionality of the terminal electrode and glass seals are so widely known that an individual explanation of each has been omitted. The description now turns to center electrode assembly 34, the lower axial end of which can be seen in greater detail in FIGS. 2A–2C.

Figure 2A:
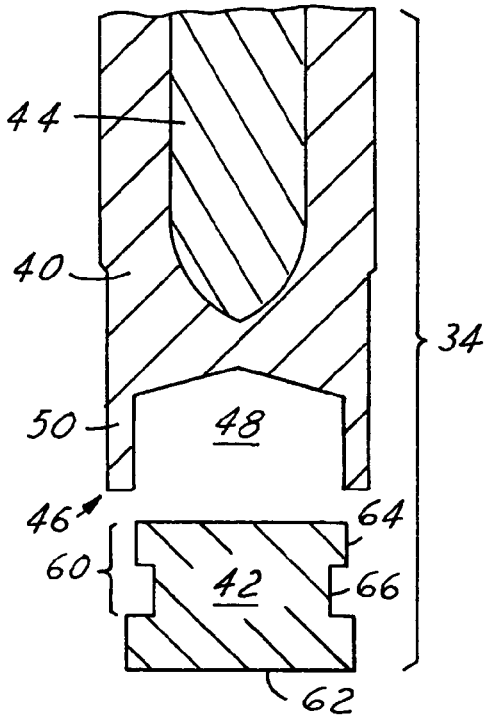
FIG. 2A is an enlarged view of the lower axial end of the center electrode assembly used in the spark plug of FIG. 1 and before attachment of a precious metal insert into the center electrode.

FIG. 2A shows the lower axial end of center electrode assembly 34 before attachment of a precious metal insert 42 to a copper-cored center electrode 40. Center electrode 40 is an elongated metallic electrode located at the lower axial end of center wire assembly 18, and includes a copper core 44 for improved heat transfer, as is known in the art and as disclosed in U.S. Pat. No. 4,814,665, which is hereby incorporated by reference. The upper axial end (not shown in FIG. 2A) of center electrode 40 typically includes a radially enlarged flange which rests upon a complimentary interior shoulder section within the axial bore of insulator 14. Lower axial end 46 of the center electrode is preformed to produce a blind hole 48 that extends upwardly into the lower axial end such that it is generally coaxial with the axis of electrode 40. The creation of blind hole 48 causes a hollow cylindrical section 50 to be formed having an upper axial end bounded by the main section of electrode 40 and a lower axial end that is free. The particular blind hole shown in FIG. 2A is created by a drilling operation, however, other operations known in the art could be used instead.

The precious metal insert embodiment shown here has a stepped configuration that is designed to be inserted into blind hole 48, and generally includes a mechanical interlock feature 60 and a sparking surface 62. As is widely known in the art, the precious metal insert may be comprised of Pt, Ir, Pd, Rh, W, Au, Ru, Ag, Os, or any other material or combination of materials exhibiting the desired characteristics such as reduced sparking voltage or resistance to electrical erosion and/or chemical corrosion. The mechanical interlock feature 60 is an exterior surface feature of the precious metal insert that, in conjunction with the inner surface of hollow cylindrical section 50, creates a mechanical attachment between center electrode 40 and the precious metal insert 42, thereby forming center electrode assembly 34. This mechanical interlocking of these components augments the strength of a metallurgical attachment created by a circumferential weld between the two components. This weld is described further below. The mechanical interlock feature 60 shown here is in the form of an enlarged head section of the insert which generally includes an upper axial section 64 and a lower axial section 66, each of which is cylindrically shaped. The radius of the upper axial section is greater than that of the lower axial section, such that an abrupt radial change occurs between the two sections. Of course, the mechanical interlock feature may have different ratios than those shown in FIG. 2A, such as axial height-to-axial height, axial height-to-radial depth, and other dimensional ratios involving the upper and lower axial sections 64 and 66. Sparking surface 62 is the primary surface from which an ignition pulse arcs from the center electrode assembly 34 to ground electrode 16, thereby creating a combustion initiating spark. This particular sparking surface is flat, however, rounded surfaces or surfaces of other shapes and designs may be utilized.

Figure 2B:
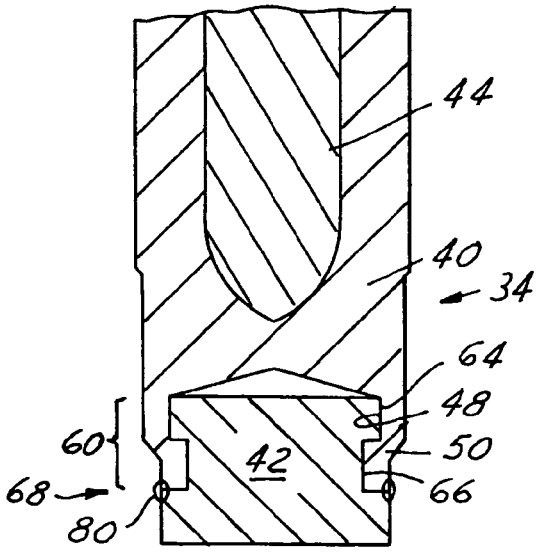
FIG. 2B is an enlarged view showing the lower axial end of the center electrode assembly of FIG. 1 after attachment of the precious metal insert.

Turning now to FIG. 2B, the lower end of center electrode assembly 34 is shown after the assembly process; that is, after precious metal insert 42 has been permanently attached to center electrode 40. During assembly, the precious metal insert is placed into blind hole 48 such that the mechanical interlock feature 60 is at least partially located within the blind hole. Once the precious metal insert is fully inserted, a tool is brought into place that circumferentially surrounds the exterior of hollow cylindrical section 50 and exerts a radially inward force upon that section. This force is primarily exerted in a lower axial region of the hollow cylindrical section such that it is mechanically deformed. This results in a center electrode assembly similar to that shown in FIG. 2B, where the inner surface of hollow cylindrical section 50 contacts the outer surface of both the upper and lower axial sections 64, 66 of the mechanical interlock feature. Once deformed, the outer radius of the lower axial region of cylindrical section 50 is approximately equal to the outer radius of the lower axial region of the precious metal insert, thereby creating a smooth transition 68 between adjacent outer surfaces of those two components.

Figure 2C:
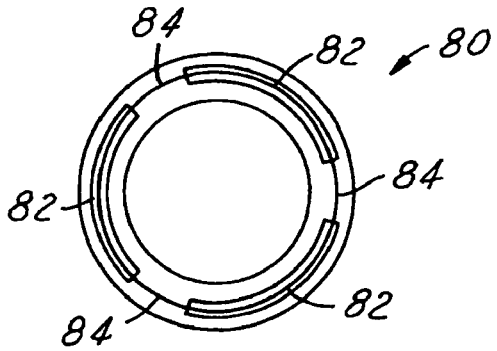
FIG. 2C is a bottom view of the center electrode assembly of FIG. 2B depicting the vapor-vented weld used to attach the precious metal insert to the center electrode.

With reference now also to FIG. 2C, there is shown the circumferential weld 80 that is located on the exterior peripheral interface between center electrode 40 and precious metal insert 42 at smooth transition 68. This particular weld includes three arcuate weld sections 82 separated by three arcuate weld interruptions 84. The weld interruptions function as vapor vents for allowing gases to escape that would otherwise be trapped. This venting decreases the mechanical stress exerted upon weld 80 that would otherwise occur due to pressure buildup of trapped gases when the center electrode is heated during use, and thus reduces the possibility of joint failure and separation of the precious metal insert from the electrode. Welding can be done by any suitable technique such as by laser welding. Preferably, circumferential weld 80 includes three arcuate weld sections, each extending approximately 90°. This intermittent weld results in three arcuate weld interruptions, each equally spaced from the others by about 120° and extending approximately 30°. It should be recognized, however, that the number of either the arcuate weld sections or the weld interruptions, the angular extent (arcuate length) of either the weld sections or the weld interruptions, as well as other attributes of circumferential weld 80 may differ from those shown in this embodiment. For example, circumferential weld 80 could include one, two, four, five, or any other reasonable number of arcuate weld sections. Also, the arcuate length of the weld sections and weld interruptions could be equal or the weld interruptions could be of greater arcuate length than that of the weld sections. Other modifications and changes will become apparent to those skilled in the art.

Figure 3:
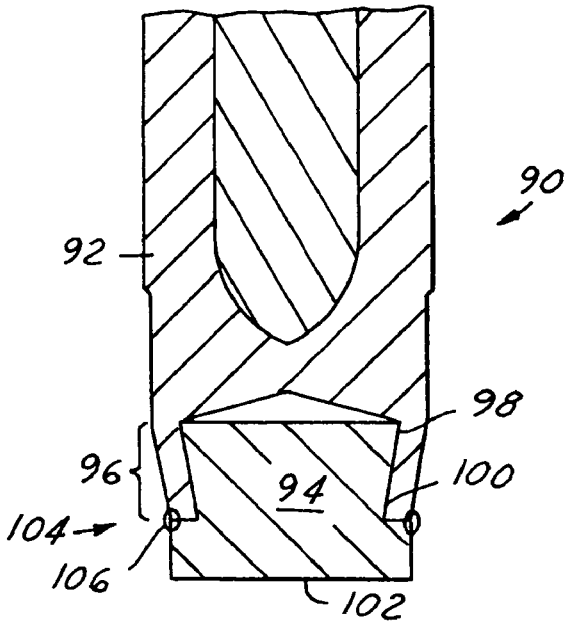
FIG. 3 is an enlarged view of the lower axial end of a second embodiment of the center electrode assembly of the present invention.

Referring now to FIG. 3, there is shown a second embodiment of a center electrode assembly 90 of the present invention. As with the previous embodiment, center electrode assembly 90 includes a center electrode 92 and a precious metal insert 94. However, the precious metal insert 94 includes a mechanical interlock feature that has a generally sloped configuration, as opposed to the stepped configuration seen in FIGS. 2A–B. Precious metal insert 94 generally includes a mechanical interlock feature 96 having upper and lower axial sections 98, 100, respectively, and a sparking surface 102. The mechanical interlock feature is sloped such that it smoothly extends between upper axial section 98, which has a greater radius than the lower axial section, and lower axial section 100. Hence, the mechanical interlock feature of this embodiment does not have the abrupt radial changes seen in the previous embodiment.

The assembly process is substantially the same as that previously discussed. Once the precious metal insert is located within the blind hole, a tool is brought into place such that it circumferentially surrounds the hollow cylindrical portion of the electrode. This tool applies a radially inward force against the lower end of the hollow cylindrical section of electrode 92 such that it deforms that end around the mechanical interlock feature 96. Once deformed, an inner surface of the hollow cylindrical portion evenly contacts the outer surface of both the upper and lower axial sections 98, 100 of the mechanical interlock feature, thereby mechanically attaching electrode 92 and precious metal insert 94 together. As with the previous embodiment, the outer radius of the deformed hollow cylindrical section is approximately the same as the outer radius of the lower region of the precious metal insert, thereby forming a smooth transition 104 between the two components. It is at this smooth transition that an intermittent circumferential weld 106 having weld sections and weld interruptions is created. Circumferential weld 106 is largely the same as the circumferential weld 80 shown in FIG. 2C, thus a second explanation has been omitted.

Figure 4A:
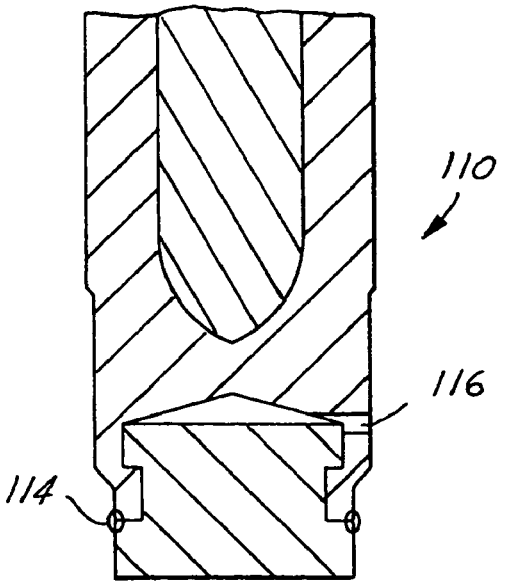
FIG. 4A is an enlarged view of the lower axial end of a third embodiment of the center electrode assembly of the present invention having a radially extending vent hole.
Figure 4B:
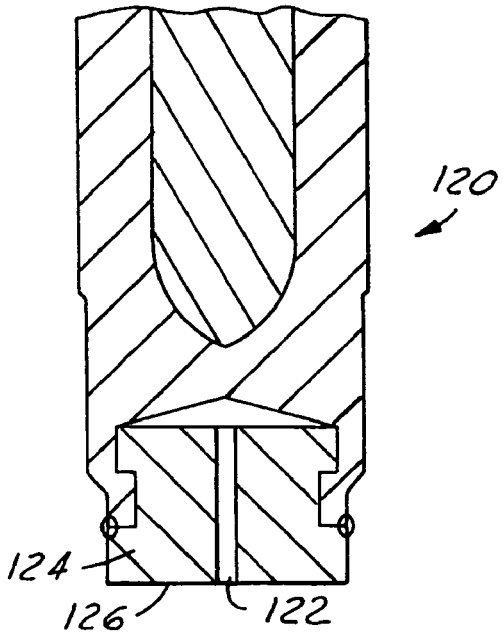
FIG. 4B is an enlarged view of the lower axial end of a fourth embodiment of the center electrode assembly of the present invention having an axially extending vent hole.

Turning now to FIGS. 4A and 4B, there are shown two additional center electrode assembly embodiments that each include a vapor releasing vent hole in place of the previously described weld interruptions. Center electrode assembly embodiment 110 includes the copper-cored center electrode and precious metal insert shown in FIGS. 2A–2B, however the circumferential weld 114 is continuous; that is, it does not have any weld interruptions. In order to provide venting for gases that would otherwise be trapped in the blind hole, a vent hole 116 radially extends from the space located above the upper axial end of the precious metal insert to the exterior of the assembly. The diameter and length, as well as other attributes of this channel, may vary to accommodate the particulars of the application. Alternatively, FIG. 4B shows a center electrode assembly embodiment 120 that includes an axially extending vent hole 122, instead of the radially extending vent hole 116 of FIG. 4A. The axially extending vent hole extends along the center axis of precious metal insert 124 such that any gasses trapped in the blind hole may be vented out through a sparking surface 126.

It will thus be apparent that there has been provided in accordance with the present invention, a center electrode assembly for use with a spark plug that achieves the aims and advantages specified herein. It will, of course, be understood that the foregoing description is of several preferred exemplary embodiments of the invention and that the invention is not limited to the specific embodiments shown. For instance, the exemplary combination of center wire assembly components, including a terminal electrode, one or more glass seals, a center electrode, etc., could just as easily be comprised of a different combination of components. Furthermore, the center electrode does not have to be copper-cored; it could include no separate core whatsoever, or it could be cored with a material other than copper. Also, the precious metal insert could be mechanically interlocked with the center electrode without preforming the blind hole, but rather by melting of the lower axial end and embedding the precious metal insert into the molten electrode material. This creates the blind hole while mechanically interlocking the two components together. Various other changes and modifications will become apparent to those skilled in the art and all such changes and modifications are intended to be within the scope of the present invention.

As used in this specification and appended claims, the terms "for example," "for instance," and "such as," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. An electrode assembly for use in an ignition device, comprising:

an elongated center electrode having a lower axial end with a blind hole extending into said lower axial end; and a precious metal insert having a mechanical interlock feature and a sparking surface;

wherein said mechanical interlock feature is located at least partially within said blind hole with said lower axial end engaging said interlocked feature such that an inner surface of said blind hole circumferentially contacts an outer surface of said mechanical interlock feature, and wherein said center electrode is joined to said precious metal insert by a peripheral weld with said weld including at least one interruption that permits trapped gases to escape from said blind hole.

2. The electrode assembly of claim 1, wherein said mechanical interlock feature is of a stepped design having upper and lower axial sections, such that the radius of said mechanical interlock feature abruptly changes between said upper and lower axial sections.

3. The electrode assembly of claim 2, wherein the radius of said mechanical interlock at said upper axial section is greater than the radius of said mechanical interlock at said lower axial section.

4. The electrode assembly of claim 1, wherein said mechanical interlock feature is of a sloped design having upper and lower axial sections, such that the radius of said mechanical interlock feature gradually changes between said upper and lower axial sections.

5. The electrode assembly of claim 4, wherein the radius of said mechanical interlock at said upper axial section is greater than the radius of said mechanical interlock at said lower axial section.

6. The electrode assembly of claim 1, wherein a lower portion of said precious metal insert includes an outer radius that is equal to an outer radius of said lower axial end such that a smooth transition occurs between adjacent outer surfaces of said electrode and said precious metal insert.

7. The electrode assembly of claim 6, wherein said weld circumferentially extends around said assembly at said smooth transition.

8. The electrode assembly of claim 1, wherein said electrode includes a copper core.

9. The electrode assembly of clam 1, wherein said precious metal insert is made of platinum, iridium, or combination of platinum and iridium, or an alloy that includes either platinum or iridium.

10. The electrode assembly of claim 1, wherein said weld includes three of said interruptions, each spaced approximately 120° from the other interruptions.

11. An electrode assembly for use in an ignition device, comprising:

an elongated electrode having a lower axial end with a blind hole extending into said lower axial end;

a precious metal insert having a mechanical interlock feature and a sparking surface; and a vent hole extending from an interior location of said blind hole to a location exterior of said assembly;

wherein said mechanical interlock feature is at least partially located within said blind hole, with said lower axial end engaging said interlock feature such that an inner surface of said blind hole circumferentially contacts an outer surface of said interlock feature, and wherein said electrode is welded to said precious metal insert at an outer peripheral interface between said electrode and said precious metal insert.

12. The electrode assembly of claim 11, wherein said vent hole radially extends through said lower axial end.

13. The electrode assembly of claim 11, wherein said vent hole axially extends through said precious metal insert.

14. An ignition device for use in an internal combustion engine, comprising:

a metallic shell having a central bore;

an insulator secured within said central bore and having an axial bore that is generally coaxial with said central bore; and a center wire assembly secured within said axial bore and at least comprising:

an elongated electrode having a lower axial end with a blind hole extending into said lower axial end; and a precious metal insert having a mechanical interlock feature and a sparking surface;

wherein said mechanical interlock feature is at least partially located within said blind hole with said lower axial end engaging said interlock feature a such that an inner surface of said blind hole circumferentially contacts an outer surface of said interlock feature, and wherein said lower axial end is joined to said precious metal insert by a peripheral weld with said weld including at least one interruption that permits trapped gases to escape from said blind hole.

15. The ignition device of claim 14, wherein said ignition device comprises a spark plug.

16. The ignition device of claim 14, wherein said ignition device comprises an igniter.

17. A method of manufacturing an electrode assembly for use in an ignition device, comprising the steps of:

(a) providing an elongated electrode having a lower axial end with a blind hole extending into said lower axial end;

(b) providing a precious metal insert having a mechanical interlock feature and a sparking surface;

(c) inserting said precious metal insert into said blind hole such that at least a portion of said mechanical interlock feature is located within said blind hole;

(d) mechanically deforming said lower axial end such that an inner surface of said blind hole circumferentially contacts an outer surface of said mechanical interlock feature; and (e) intermittently welding said precious metal insert to said electrode about an outer peripheral interface between said insert and electrode, whereby said intermittent welding results in a weld having interruptions that permit trapped gases to escape from said blind hole.

18. A method of manufacturing an electrode assembly for an ignition device, comprising the steps of:

mechanically interlocking a precious metal insert onto an end of a center electrode;

welding the precious metal insert to the center electrode about a peripheral surface interface between the precious metal insert and center electrode; and providing a vent for trapped gases located between the precious metal insert and center electrode.

19. The method of claim 18, wherein said welding and providing steps together comprise intermittently welding said precious metal insert to said electrode such that an outer peripheral weld is formed having at least one weld interruption.

20. The method of claim 18, wherein said providing step further comprises providing a vent hold from said blind hole to an exterior surface of said electrode assembly.

21. An electrode assembly for use in an ignition device, comprising:

an elongated center electrode having a lower axial end with a blind hole extending into said lower axial end;

a precious metal insert having a mechanical interlock feature and a sparking surface;

a mechanical attachment formed from said lower axial end and operative to engage said mechanical interlock feature; and a peripheral weld joining said center electrode and said precious metal insert and having at least one interruption that operatively permits trapped gases to escape from said blind hole.

22. The electrode assembly of claim 21, wherein said mechanical interlock feature is of a stepped design having upper and lower axial sections, such that the radius of said mechanical interlock feature abruptly changes between said upper and lower axial sections.

23. The electrode assembly of claim 22, wherein the radius of said mechanical interlock at said upper axial section is greater than the radius of said mechanical interlock at said lower axial section.

24. The electrode assembly of claim 21, wherein said mechanical interlock feature is of a sloped design having upper and lower axial sections, such that the radius of said mechanical interlock feature gradually changes between said upper and lower axial sections.

25. The electrode assembly of claim 24, wherein the radius of said mechanical interlock at said upper axial section is greater than the radius of said mechanical interlock at said lower axial section.

26. The electrode assembly of claim 21, wherein a lower portion of said precious metal insert includes an outer radius that is equal to an outer radius of said lower axial end such that a smooth transition occurs between adjacent outer surfaces of said electrode and said precious metal insert.

27. The electrode assembly of claim 26, wherein said weld circumferentially extends around said assembly at said smooth transition.

28. The electrode assembly of claim 21, wherein said electrode includes a copper core.

29. The electrode assembly of clam 21, wherein said precious metal insert is made of platinum, iridium, or combination of platinum and iridium, or an alloy that includes either platinum or iridium.

30. The electrode assembly of claim 21, wherein said weld includes three of said interruptions, each spaced approximately 120° from the other interruptions.

* * * * *